United States Patent [19]

Bourda

[11] 4,406,027

[45] Sep. 27, 1983

[54] ARTICULATED FRAMEWORK FOR BED, RELAXATION SEAT OR ARMCHAIR

[75] Inventor: Maurice Bourda, Geneva, Switzerland

[73] Assignee: Etablissement Conceptex, Switzerland

[21] Appl. No.: 70,497

[22] Filed: Aug. 28, 1979

[30] Foreign Application Priority Data

Aug. 30, 1978 [CH] Switzerland ..... 9142783
Aug. 30, 1978 [CH] Switzerland ..... 9145789

[51] Int. Cl.[3] ..... A47C 19/04; A47C 17/16; A61G 7/00

[52] U.S. Cl. ..... 5/17; 5/66; 5/67; 5/181; 5/202

[58] Field of Search ..... 5/14, 17, 28, 29, 30, 5/31, 53 R, 66–69, 181, 183, 184, 202; 297/405, 105, 457

[56] References Cited

U.S. PATENT DOCUMENTS

| | | | |
|---|---|---|---|
| Re. 24,128 | 3/1956 | Creveling et al. | 5/31 |
| 2,786,213 | 3/1957 | Creveling et al. | 5/31 |
| 3,309,717 | 3/1967 | Black | 5/183 |
| 3,353,193 | 11/1969 | Greiner | 5/66 |
| 3,974,530 | 8/1976 | Lusch et al. | 5/66 |

*Primary Examiner*—Alexander Grosz
*Attorney, Agent, or Firm*—Fidelman, Wolffe & Waldron

[57] ABSTRACT

Disclosed is an adjustable bed or chair apparatus having a backrest, seat, and legrest or kneerest, each of which is angularly adjustable relative to a support frame; and the legrest and backrest are lengthwise adjustable for respectively different leg and torso lengths. A curved lever is pivotally attached to the support frame, backrest, and seat such that an occupant of the apparatus can angularly adjust the seat and backrest relative to the support frame by means of a hand lever. Locking of the angular positions of the backrest and seat is facilitated by a strap, spring, and cam arrangement.

9 Claims, 4 Drawing Figures

ARTICULATED FRAMEWORK FOR BED, RELAXATION SEAT OR ARMCHAIR

The present invention is concerned with an articulated framework for bed, relaxation seat or armchair, comprising three parts mounted on a support, these parts forming respectively a back-rest, a seat and a knee-rest.

Articulated beds are more particularly intended for hotels, hospitals and convalescence homes, establishments which receive a large number of people of different sizes. The comfort of a user of such a bed depends not only on the length of this bed, but also on the way it is articulated. Generally, articulated beds which are mass produced have a standard length of 1,90 m. Longer beds, for tall people, are produced in small series and, consequently, cost appreciably more.

The blocking means generally used in the articulated units often comprise a pressing component operating on the two parts at their articulation level, in a parallal way to the axis of this articulation. The pressing component is operated by a control and blocking lever which is assured by the friction of the two parts, one against the other, and which depends on the effort made by the user.

One object of the present invention is to produce an articulated bed framework which can be adapted to several useful lengths, without any repercussion on the cost price.

Another object of the present invention is to produce an articulated framework for bed or relaxation seat, equipped with blocking means which are easy to use, not needing any extra pressure and which cannot be loosened at an unsuitable time.

These objectives are arrived at, thanks to the present invention, in that the articulated bed, such as it has been defined previously, is characterized in that its framework includes means of modifying the position of at least one of the end parts, back rest or knee rest with respect to the seat, in order to be able to modify the total length of the bed, and blocking means in order to lock the back-rest in position with respect to the seat.

Moreover, the blocking means comprise a strap fixed by its ends respectively to each end of the lever, at least one cam eccentric subject to the action of a return-spring tending to hold it in a position where it presses the strap against a supporting plaque solid with the support, and control means capable of pivoting the cam eccentric against the action of the spring in order to free the strap.

Figure 1:
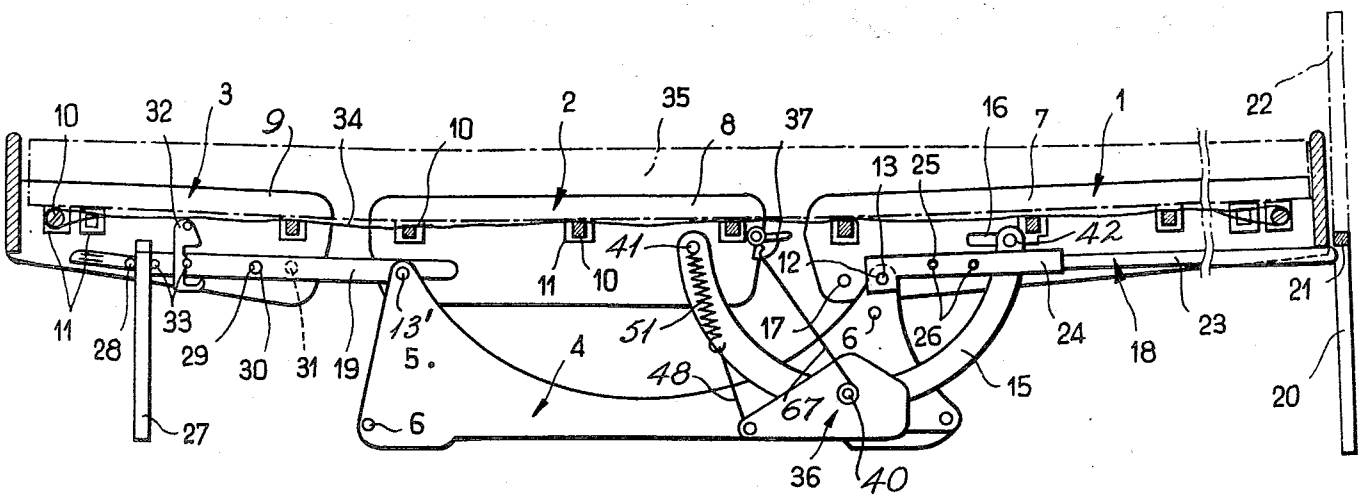

The present invention will be better understood with reference to the description of a production example and of the attached drawing on which:

FIG. 1 represents a view of an articulated framework according to the invention, shown from above.

Figure 2:
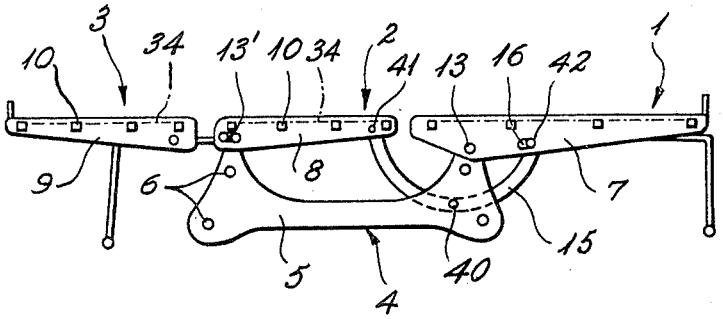
Figure 3:
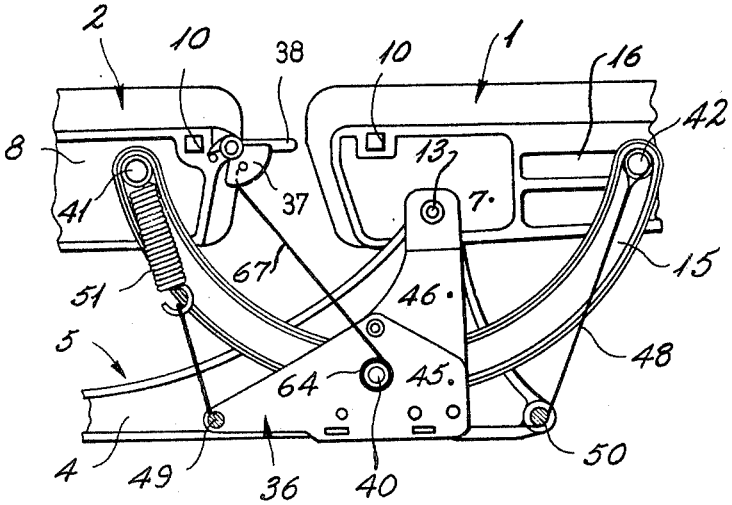
Figure 4:
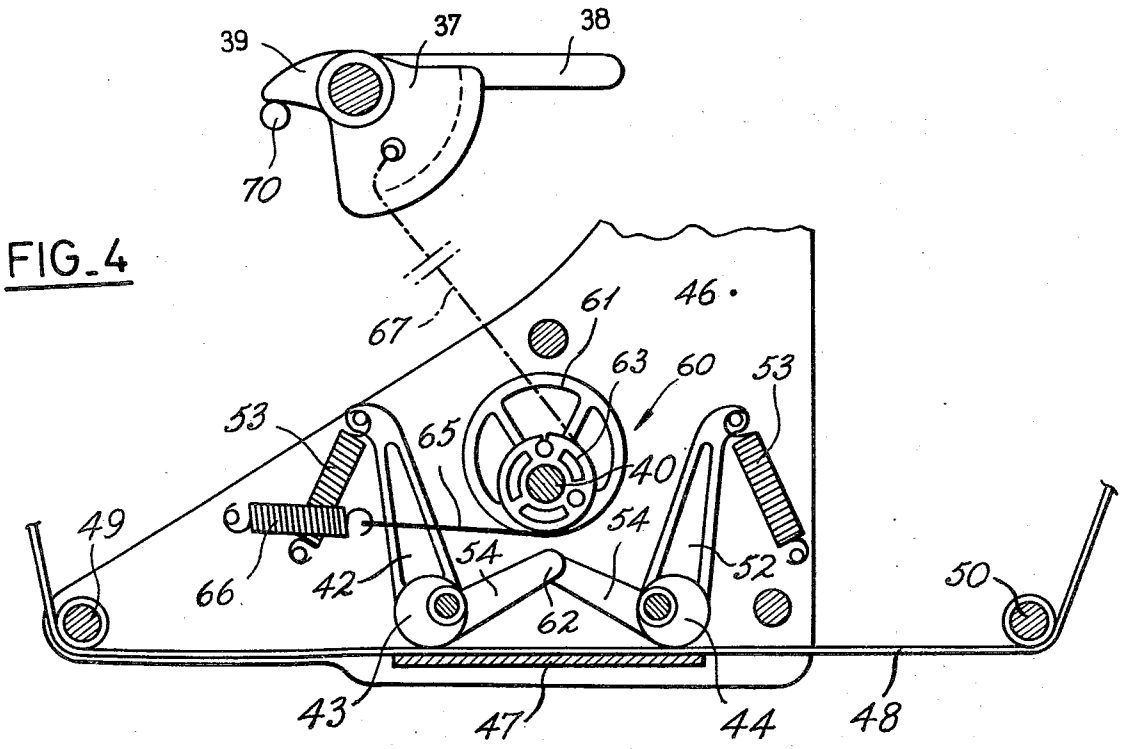

FIG. 2 illustrates a diagrammatic form, stripped down, of the framework of FIG. 1, illustrating in particular the disposition of the blocking means of the back-rest with respect to the seat, FIG. 3 illustrates a first longitudinal section view, according to a first plan of the bed articulation including the means of locking the back-rest with respect to the seat, FIG. 4 illustrates a second longitudinal section view of the bed articulation, according to a second plan parallel to the said first plan of section.

With reference to FIG. 1, the framework for an articulated bed comprises three parts, respectively a back-rest 1, a seat 2, and a knee-rest 3. These three parts 1, 2, and 3 are mounted on a support 4 constituted by two sides 5 connected by rails 6 forming a cross-piece. In a similar way, the back-rest 1, the seat 2 and the knee-rest 3 are formed by two sides respectively 7, 8 and 9 connected by cross-pieces 10. These latter are fixed to each of their ends in recesses 11 of the sides 7, 8 and 9.

Back-rest 1 is articulated on the support 4, a boring 12 in each of its sides 7 being passed through by a pivot 13 solid with each side 5 of the support 4.

Each of the sides 8 of the seat 2 present a groove in which is fitted a rail 13'. On each side of the framework, a curved lever 15 pivoted on the side 5 of the support 4, connects the back-rest 1 to the seat 2. One of the ends of this lever 15 pivots on the side 8 of the seat 2, while the other end of this lever 15 is guided in a groove 16 of the sides 7 of the back-rest 1.

Each of the sides 7 of the back-rest 1 present a second boring 17 capable of co-operating with an articulation pivot 13. When the pivots 13 are mounted in these borings 17, the useful length of the framework between the seat 2 and the back-rest 1 increases in size by a length equal to that of the space of the two borings 12, 17 of each side 7.

Horizontal side-members 18 and 19 are fixed to the support 4 and extend respectively under the back-rest 1 and under the leg-rest 3. The side-members 18 are made solid at their free ends with two legs 20 connected by a bar 21. A head-board 22 is capable of being fixed in the extension of the legs 20. The side-members 18 constitute a stop for the back-rest 1 when it is in the horizontal position, as illustrated on the drawing.

In order to be able to adapt borings 12 and borings 17 to an elongation of the framework by moving the back-rest 1 articulation, the side members 18 are constituted of two tubular sections 23, 24, fitted into one another. The interior section 23 presents an elastic finger 25 capable of fitting into two holes 26 of the exterior section 24.

The side-members 19 are supported at their free end by a pair of legs 27 connected by a bar 28. The side-members 19 carry, each one, a pivot 29 capable of co-operating with one or the other of the two borings 30, 31 foreseen in the sides of the leg-rest 3.

A notch blocking device 32 allows the adjustment of the angle of the leg-rest 3 with respect to the side members 19. This device 32 co-operates with one or the other of two tenons 33 according to the borings 30 or 31 in which the pivots 29 are fitted. The cross-pieces 10 act as supports to a cloth 34 whose ends cover the cross-pieces 10 placed at the opposite ends of the back-rest 1 and the leg-rest 3. In order to be able to keep cloth 34 whatever way the articulations of the back-rest 1 and the leg-rest 3 are mounted, the cross pieces 10 acting as fixing elements to the cloth 34 are capable of being mounted, each one, in two recesses 11 of each side 7 and 9 of the back-rest 1 and the leg-rest 3.

The framework described above is intended to receive a mattress 35 represented by dots and dashes on the drawing.

A bed with this framework is capable of being put in all intermediary positions between the horizontal position as illustrated on the drawing and the said relaxation position in which the back-rest 1 is raised. A locking device 36, self-blocking, controlled by a lever 38 fixed on the seat, allows the locking of the bed in a position desired by the user.

Usually, the user of a bed equipped with this framework can modify his position by pressing harder on the back-rest 1 or on the seat 2 after having released the locking device 36. By pressing harder on the seat 2, the latter gives way and the back-rest 1 is raised up; on the other hand, by pressing on the back-rest 1, the latter is lowered and the seat rises up again.

The framework for an articulated bed described above has the advantage of being able to present several lengths or even to be able to be modified as far as the length is concerned without any one of its constituent parts being replaced.

Numerous variants of the framework which is the object of the invention could be foreseen.

In particular a framework could be considered where the back-rest 1 presents pivots capable of being mounted in two borings of each side 5 of the support. In this variant, in the said relaxation position, the apparent length of the seat 2 is more or less great depending on the borings in which are mounted the said pivots. In a similar way, the leg-rest 3 could be capable of being articulated in several borings foreseen in the side-members 19.

The framework represented by FIG. 2 is intended more particularly to form a relaxation bed. This bed comprises three parts, i.e. a back-rest 1, a seat 2 and a leg-rest 3, articulated on a support 4 resting on the ground.

The support 4 is formed by two lateral sides 5 connected by cross bars 6 forming a cross-piece.

Parts 1, 2 and 3 are each constituted by two lateral sides, respectively 7, 8 and 9, connected by cross-pieces 10. These latter act as fixing elements to a cloth or several parallel straps, represented diagrammatically by dots and dashes 34.

The upper ends of the sides 5 of the suppport 4 present pivots 13 and 13'. Pivots 13 are fitted into the borings of the sides 7 of the back-rest 1 and the pivots 13' co-operate with the grooves of sides 8 of the seat 2.

Each side 5 of the support 4 presents moreover an articulation pivot 40 for a curved lever 15. One of the ends of each of these levers 15 is fitted on a finger 41 of a side 8 of the seat 2, while the other end of this lever carries a finger 42 fitted in a groove 16 of a side 7 of the back-rest 1.

Usually, the user of a bed presenting a framework of this type can, depending on whether he presses harder on the back-rest 1 or on the seat 2, respectively lower or raise the back-rest 1, which corresponds to a rise or depression of the seat 2. During the movements of the back-rest 1 and the seat 2, the curved levers 15 pivot with respect to the sides 5 of the support 4. In order to block the bed framework in a given position, these levers 15 are simply locked angularly with respect to the support 4.

To this effect, a locking device 36, illustrated on FIGS. 3 and 4, is placed on each side of the framework, fixed on the inside of the sides 5 of the support 4. Each locking device 36 comprises two cams constituted by eccentrics 43, 44 mounted pivoting between two parallel sheets of metal 45, 46, these cams 43, 44 being placed opposite a supporting plaque 47 solid with the said sheets of metal 45, 46.

A strap 48, fixed at the ends of the lever 15, along the sides of the fingers 41 and 42, is guided by rollers 49 and 50 between the supporting plaque 47 and the cams 43 and 44. This strap 48 is held taut by a spring 51 acting between the side of the finger 41 and one end of the strap 48.

Each cam 43, 44 presents two lever arms, a first lever arm 52, at the end of which acts a spring 53, and a second lever arm 54 capable of co-operating with releasing means 60.

Due to the action of the springs 53, the cam eccentrics 43, 44 press elastically the belt 48 against the supporting plaque 47. These two cams 43, 44 are placed in such a way as to assure the locking of the strap 48 by selftightening against the supporting plaque 47, each one in a direction of movement of the strap 48 with respect to the supporting plaque 47.

When, for example, the strap 48 moves from left to right on FIG. 4, it drives by friction the cam 43. This latter pivots and, by its form, increases the tightness of the strap 48 against the supporting plaque 47 until it is locked.

The releasing means 60 include an eccentric 61 capable of co-operating with the ends 62 of the lever arms 52 and 54. This eccentric 61 is mounted pivoting between the two sheets of metal 45, 46 along the articulation axis 40 of the lever 15. The eccentric 61 is angularly integral with two pulleys 63, 64. Around the first pulley 63 is rolled a cable 65 subject to the action of a return-spring 66. Around the second pulley 64, as can be seen on FIG. 3, is rolled, on one end, a driving cable 67, whose other end is made integral with a sector 37 mounted pivoting on one side 8 of the seat 2 according to an axis whose distance with the pivoting axis of the eccentric 61 is appreciably constant for all the positions of the framework. The sector 37 is angularly integral with an operating handle 38 and presents a stop notch 39 resting against a finger 70. Preferably, the sectors 37, placed each one beside the bed framework, are made angularly integral with each other in such a way as to be operated simultaneously by a single operating handle 38.

In the rest position, as illustrated on FIG. 4, the eccentric 61 is separated from the ends 62 of the levers 54. It is held in this position by the return-spring 66 acting on the pulley 63 through the intermediary of the cable 65, the stop notch 39 of the sectors 37 resting against the finger 70.

When a user wishes to change the position of the bed framework, he must simply lower the operating handle 38 against the action of the return-spring 66. During this movement, the sector 37 pivots and drives, through the intermediary of the driving cable 67, the eccentric 61 in a pivoting of anticlockwise direction, with reference to FIG. 4. The eccentric 61 co-operates with the ends 62 of the lever arms 54 and pivots the cams 43, 44 in such a way as to release the strap 48. The user can then change the position of the framework and lock it in a new position by simply loosening hold on the handle 38.

It can be seen that with the articulated framework described above, the locking device can easily be operated by the user. Moreover, an unsuitable releasing is impossible.

Thanks to the spring 51, the seat 2 and the back-rest 1 can pivot lightly in one direction or the other, which assures a certain flexibility as far as the seat and the back-rest are concerned and thereby, more comfort for the user.

Many variants of the articulated framework, which is the object of this invention, can be foreseen.

The strap 48 could be pulled taut by a tightener constituted in a known way by a roller subject to the action of a spring, the two ends of the strap 48 being fixed at the ends of the lever 15. A production form could be considered where the cams 43, 44 are placed opposite the rollers 49, 50 and are capable of locking the belt 48 by self-tightening against these rollers 49, 50.

An articulated framework could also be considered where the lever 15 is integral with a circular sector against which act the cams 43, 44. Where this variant is concerned, the circular sector could carry on its circumference a friction fitting.

I claim:

1. An articulated framework for a bed, relaxation seat, or armchair and comprising:

three parts mounted on a support, said three parts forming respectively a back-rest, seat, and knee-rest, at least one of said three parts pivotal about an articulation axis;

adjustment means adapted for adjustment of said articulation axis of at least one of said knee-rest and said back-rest relative to said seat to modify said framework lengthwise, whereby mattresses of different lengths may be accommodated by said framework; and blocking means for locking said back-rest in position relative to said articulation axis.

2. An apparatus as in claim 1, further comprising:

two lateral sides on each of said three parts and crosspieces connecting opposed sides of each of said parts, said back-rest and said knee-rest each having an end crosspiece for attaching a protective mattress cloth at each end of said bed, said end crosspieces being adapted for adjustment lengthwise of said bed, whereby said protective mattress cloth may accommodate said lengthwise adjustment of said bed.

3. An apparatus as in claim 2, further comprising:

horizontal side members adapted for lengthwise adjustment, said horizontal side members including legs and a headboard, whereby said headboard may be adjusted lengthwise of said framework to accommodate lengthwise adjustment of said framework.

4. An apparatus as in claim 1, further comprising:

a curved lever having a first end and a second end, said curved lever pivotally attached to said support, between said first and second ends;

groove means for sliding attachment of said first end to said back-rest;

pivot means for pivotal attachment of said second end to said seat; and said blocking means comprising a plaque attached to said support, a strap connected between said first and second ends of said curved lever and adapted for adjustment relative to said plaque, cam means for pressing said strap against said plaque under the bias of at least one spring, and control means actuatable for pivoting said cam means against the bias of said spring, whereby said strap may be adjusted relative to said plaque upon actuation of said control means.

5. An apparatus as in claim 4, wherein said cam means further comprises two spring biased cams for pressing said strap against said plaque, said two cams adapted to prevent movement of said strap in either direction relative to said plaque when said control means is not actuated.

6. An apparatus as in claim 4, wherein said cam means further comprises at least one attached lever arm operable by said control means for pivoting said cam means against the bias of said spring.

7. An apparatus as in claim 6, wherein said control means further comprises an eccentric subject to a restoring torque tending to move said eccentric out of engagement with said lever arm, said eccentric engageable with said lever arm when said control means is actuated.

8. An apparatus as in claim 7, wherein said control means further comprises:

a pulley attached for movement with said eccentric;

a cable attached at one end to said pulley and at the other end to a handle, whereby movement of said handle moves said cable to rotate said pulley.

9. An apparatus as in claim 4, and further comprising an elastic means attaching said strap to said curved lever for keeping said strap in tension.

* * * * *